US005291755A

United States Patent [19]

Grant

[11] Patent Number: 5,291,755

[45] Date of Patent: Mar. 8, 1994

[54] SIMULATED BIBLE CHARM

[76] Inventor: Vonda C. Grant, 15200 Glenwood, Detroit, Mich. 48205

[21] Appl. No.: 983,800

[22] Filed: Nov. 30, 1992

Related U.S. Application Data

[63] Continuation-in-part of Ser. No. 954,243, Sep. 30, 1992.

[51] Int. Cl.[5] ..... A44C 25/00

[52] U.S. Cl. ..... 63/23; 63/19

[58] Field of Search ..... 63/18, 19, 23, DIG. 3; 40/634, 330; D11/81

[56] References Cited

U.S. PATENT DOCUMENTS

| | | | |
|---|---|---|---|
| D. 260,139 | 8/1981 | Gould . | |
| D. 276,983 | 1/1985 | Falco . | |
| D. 282,055 | 1/1986 | Brinkers . | |
| 46,788 | 3/1865 | Foote | 63/19 |
| 175,394 | 3/1876 | Untermeyer | 63/19 |
| 206,012 | 7/1878 | Granbery | 63/19 |
| 420,757 | 2/1890 | Adams | 63/19 |
| 1,655,341 | 1/1928 | Snellgrove | 63/23 |
| 2,121,344 | 6/1938 | Fontan | 63/23 |
| 2,129,491 | 9/1938 | Chilson | 63/19 |
| 2,138,596 | 11/1938 | Fassnacht | 63/23 |
| 2,543,437 | 2/1951 | Claxton | 63/19 |
| 4,581,904 | 4/1986 | Lehmann et al. | 63/19 X |
| 5,079,933 | 1/1992 | Alviti | 63/DIG. 3 X |

FOREIGN PATENT DOCUMENTS

| | | | |
|---|---|---|---|
| 535850 | 1/1957 | Canada | 63/19 |

OTHER PUBLICATIONS

Marchal Jewelers Charm Catalog, Mar. 1953, p. 11.

*Primary Examiner*—Peter M. Cuomo
*Assistant Examiner*—Michael Milano

[57] ABSTRACT

A charm in the form of a simulated Christian bible which has both pleasing appearance and conveys a religious message of value from the wearer to the admirer, composed of a book appearing external structure having imprinted thereon the words "The Bible", or the like, and which has, in appearance, the look commonly associated with a Christian bible. The outer cover is preferably flexibly joined with respect to the spine of the charm and may be folded back to reveal one or more internal pages which have writing thereon related to biblical passages. A mounting structure is provided at or adjacent the spine for providing connection to another piece of jewelry, such as a necklace, a bracelet or an earring.

6 Claims, 1 Drawing Sheet

SIMULATED BIBLE CHARM

CROSS-REFERENCE TO RELATED APPLICATIONS

The present Application is a Continuation-in-Part Application of Ser. No. 07/954,243, filed on Sep. 30, 1992, which is currently pending.

BACKGROUND OF THE INVENTION

1. Field of the Invention

The present invention relates to charms of the kind worn in association with necklaces, bracelets, earrings, pins, key chains, and the like, and more particularly to a charm therefor which simulates the Christian bible.

2. Description of the Prior Art

Charms are well known in the art, such as pendants which hang from necklaces, various fanciful shapes of articles that are attached to bracelets and hang from earrings, artistic expression portions of key chains, and the like. These devices are constructed usually of metal, but sometimes are constructed of other materials, such as plastic.

Generally, charms merely convey a pleasing look and have no deeper meaning to the wearer or the admirer. Accordingly, it would be beneficial in the charm art to provide a charm which has both pleasing appearance and conveys a message of value from the wearer to the admirer.

SUMMARY OF THE INVENTION

The present invention is a charm in the form of a simulated Christian bible which has both pleasing appearance and conveys a religious message of value from the wearer to the admirer.

The simulated bible charm according to the present invention is composed of a book appearing external structure having imprinted thereon the words "The Bible", or the like, nd which has, in appearance, the look commonly associated with a Christian bible. The outer cover is preferably flexibly joined with respect to the spine of the charm and may be folded back to reveal one or more internal pages which have writing thereon related to biblical passages. A mounting structure is provided at or adjacent the spine for providing connection to another piece of jewelry, such as a necklace, a bracelet, an earring, a pin, a key chain or the like.

Accordingly, it is an object of the present invention to provide a charm in the form of a simulated Christian bible.

It is another object of the present invention to provide a simulated bible charm which is connectable to other pieces of jewelry.

It is yet another object of the present invention to provide a simulated bible charm which can be worn with other jewelry and which has both pleasing appearance and conveys a religious message of value from the wearer to the admirer.

It is still a further object of the present invention to provide a simulated bible charm which contains one or more selected biblical messages of value, such as for providing inspiration.

These, and additional objects, advantages, features and benefits of the present invention will become apparent from the following specification.

DETAILED DESCRIPTION OF THE PREFERRED EMBODIMENT

Figure 1:
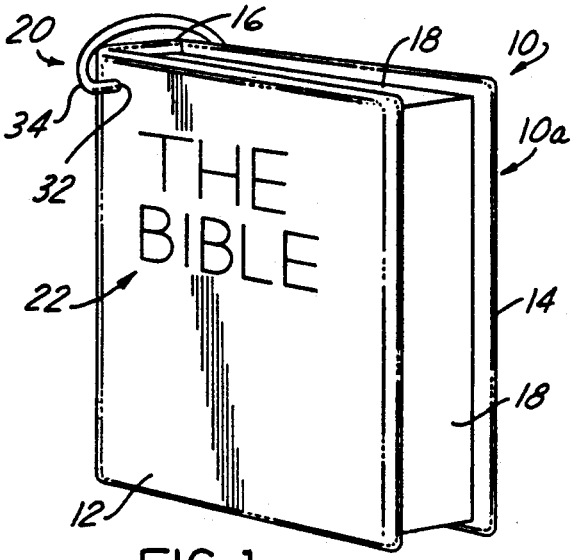
FIG. 1 is a perspective view of the simulated bible charm according to the present invention, shown in a closed configuration.
Figure 2:
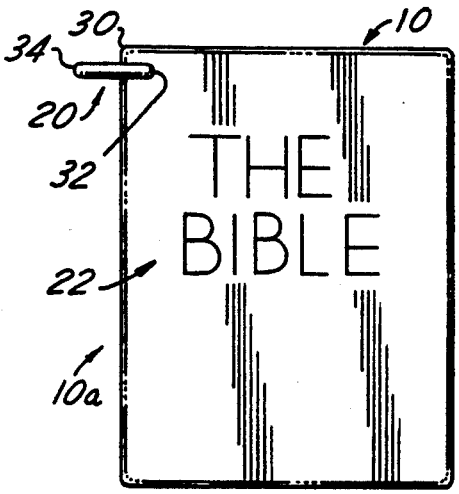
FIG. 2 is a front view of the simulated bible charm according to the present invention.
Figure 3:
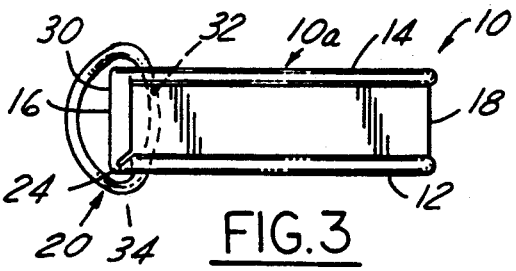
FIG. 3 is a top plan view of the simulated bible charm according the present invention.

Referring now to the Drawing, FIGS. 1 through 4 show generally the simulated bible charm 10 according to the present invention. As can be understood therefrom, the simulated bible charm 10 is composed of a main body 10*a* and a mounting member 20. The main body 10*a* includes a front cover 12, a back cover 14 a spine 16 connecting pivotably or foldably with the front cover and with the back cover, and a simulated pages portion 18 connected to the back cover and the spine. The mounting member 20 is connected to, or in the near vicinity of, the spine and serves as a mounting interface between the main body 10*a* and some other piece of jewelry with which the simulated bible charm is to be worn.

Preferably, the front and back covers 12, 14 and the spine 16 are constructed of leather, a simulated leather, or leather-like looking material, ie., plastic with a simulated leather look, preferably, but not necessarily, black, The simulated pages portion 18 is constructed of any durable weather-resistant material, having the appearance of many sheets so as to give the simulation of a thick book and is preferably of whitish or goldleaf color. The exterior of the front cover 12 preferably has nomenclature 22 thereon which identifies the simulated bible charm 10 as being a Christian bible. The nomenclature 22 is preferred to read "THE BIBLE", but other such meaning nomenclature is acceptable.

The front cover 12 is preferably mounted with respect to the spine 16 so that the front cover can be pivoted at a hinge 24 that connects each of the front cover and the spine. The hinge 24 is preferably a living hinge. Alternatively, the front cover 12 may be flexibly constructed so as to permit easy bending thereof in a direction away from the simulated pages portion 18. Normally, the simulated bible charm 10 is worn in the closed configuration shown in FIG. 1 and the front cover is periodically, as may be desired from time to time, pivoted or flexed into the open configuration shown in FIG. 4. Inside, behind the front cover 12, is at least one page 26. The at least one page 26 is constructed of a weather resistant paper or paper-appearing material, such as plastic, and has indicia 28 thereon in the form of writing from the Christian bible, such as the Ten Commandments, the Psalms, the Gospels or from other passages therein.

The mounting member 20 is a structure for interconnecting the main body 10*a* of the simulated bible charm 10 with some other piece of jewelry. Generally, the mounting member 20 is located with respect to the main body 10*a* so that the front cover 12 can be pivoted or flexed as described hereinabove and so that the center of gravity of the main body keeps the nomenclature 22 in a readable orientation, albeit perhaps angled to one side. Accordingly, the favored location for the mounting member 20 is adjacent the upper spine corner 30.

One preferred form of mounting member 20 is shown in FIGS. 1 through 4 and is composed of a hole 32 passing through the front and rear covers 12, 14 adjacent the upper spine corner 30 and a ring 34 passing therethrough. The ring 34 connects (wherever efficacious) by a clasp 42, or by another interconnection structure well known in the art of jewelry, to a chain or to other components of the jewelry being used in connection with the simulated bible charm 10.

Figure 5:
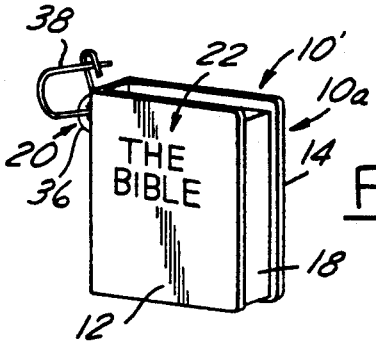
FIG. 5 is a perspective view of the simulated bible charm according to the present invention, shown in operation in connection with an earring piece of jewelry.

Another preferred form of mounting member 20 is shown in FIG. 5 and is composed of a more-or-less circular to semi-circular annular ear 36 which is connected with the spine 16 adjacent the upper spine corner 30. Again, the ear 36 may connect (again, wherever efficacious) by a clasp or by other interconnection structure well known in the art of jewelry to a chain or to other components of the jewelry being used in connection with the simulated bible charm 10.

Figure 6:
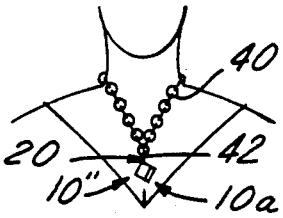
FIG. 6 is a perspective view of the simulated bible charm according to the present invention, shown in operation in connection with a necklace piece of jewelry.
Figure 7:
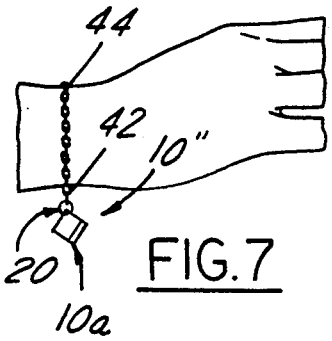
FIG. 7 is a perspective view of the simulated bible charm according to the present invention, shown in operation in connection with a bracelet piece of jewelry.
Figure 4:
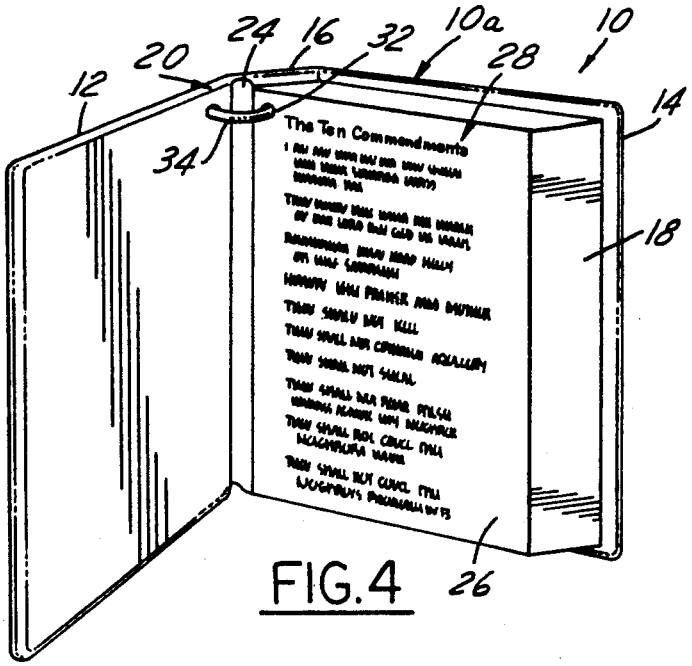
FIG. 4 is a perspective view of the simulated bible charm according to the present invention, shown in an open configuration.

FIGS. 5 though 7 show the simulated bible charm in operation in connection with certain types of pieces of jewelry, and is offered only by way of example which is not in any way to be interpreted as being exclusive of other pieces of jewelry, such as pins, key chains, or other kinds of articles, whether or not jewelry per se, structured so as to allow connection of the simulated bible chain 10 thereto. In FIG. 5, the simulated bible charm 10' is used in conjunction with an earring 38, in which the simulated bible charm is connected to the earlobe clasping portion of the earring by passage through the ear 36 of the mounting member 20. In FIG. 6, the simulated bible charm 10'' is used in conjunction with a necklace 40, in which the simulated bible charm is connected at the mounting member 20 thereof to the chain structure of the necklace via a clasp 42. Finally, in FIG. 7, the simulated bible charm 10'' is used in conjunction with a bracelet 44, in which the simulated bible charm is connected at the mounting member 20 thereof to the chain structure of the bracelet via a clasp 42.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A simulated bible charm having a Christian bible appearance, said simulated bible charm being connectable to an article, said simulated bible charm comprising:

a main body comprising:

a front cover, said front cover having nomenclature thereon indicating that said simulated bible charm is a Christian bible;

a back cover;

a spine connected with said front and rear covers, said spine having an upper corner located above said nomenclature;

a simulated pages portion located between said front cover and said rear cover; and at least one page located between said front cover and said rear cover, said page having indicia thereon in the form of selected writing from the Christian bible; and mounting means connected with said main body adjacent said upper corner of said spine for connecting said main body to the article, said mounting means comprising:

said front and rear covers each having a hole therethrough located adjacent said upper corner of said spine; and a ring passing through said hole in each of said front and rear covers;

wherein said front cover, said rear cover, said spine and said simulated pages portion are structured so as to present in combination a book-like appearance of said main body, said book-like appearance simulating that of a Christian bible in that said front cover, said rear cover and said spine have a leather-like appearance, and said simulated pages portion has a many sheets of paper appearance.

2. The simulated bible charm of claim 1, wherein said main body is constructed of weather-resistant material.

3. The simulated bible charm of claim 1, wherein said front cover is mounted to said spine by a hinge.

4. The simulated bible charm of claim 3, wherein said hinge is a living hinge.

5. The simulated bible charm of claim 1, wherein said front cover is constructed of flexible material.

6. The simulated bible charm of claim 5, wherein the article is a piece of jewelry.

* * * * *